US009968190B2

(12) United States Patent
Olson

(10) Patent No.: US 9,968,190 B2
(45) Date of Patent: May 15, 2018

(54) MEDICATION DISPENSING APPARATUS HAVING DRAWER ASSEMBLY WITH DISCRETE COMPARTMENTS

(71) Applicant: TOUCHPOINT MEDICAL, INC., Concordville, PA (US)

(72) Inventor: Jeffrey C. Olson, Dallas, PA (US)

(73) Assignee: TOUCHPOINT MEDICAL, INC., Concordville, PA (US)

( * ) Notice: Subject to any disclaimer, the term of this patent is extended or adjusted under 35 U.S.C. 154(b) by 0 days. days.

(21) Appl. No.: 14/386,118

(22) PCT Filed: Mar. 15, 2013

(86) PCT No.: PCT/US2013/032236
§ 371 (c)(1),
(2) Date: Sep. 18, 2014

(87) PCT Pub. No.: WO2013/142351
PCT Pub. Date: Sep. 26, 2013

(65) Prior Publication Data

US 2015/0042217 A1 Feb. 12, 2015

Related U.S. Application Data

(60) Provisional application No. 61/613,305, filed on Mar. 20, 2012.

(51) Int. Cl.
*G07F 11/60* (2006.01)
*A47B 67/04* (2006.01)
(Continued)

(52) U.S. Cl.
CPC ..... *A47B 67/04* (2013.01); *A47B 67/02* (2013.01); *A61J 7/0084* (2013.01); *G07F 11/60* (2013.01); *G07F 17/0092* (2013.01)

(58) Field of Classification Search
CPC ..... G07F 17/0092; G07F 11/60; A61J 7/0076; A61J 7/0084; A47B 67/02; A47B 67/04
(Continued)

(56) References Cited

U.S. PATENT DOCUMENTS 3,041,124 A * 6/1962 Armstrong ..... A47B 88/10 312/270.1
3,970,010 A 7/1976 Cantley
(Continued)

FOREIGN PATENT DOCUMENTS

WO WO9905943 2/1999

OTHER PUBLICATIONS

International Search Report and Written Opinion of the ISA for PCT/US2013/032236, ISA/US, dated Jun. 10, 2013.
(Continued)

*Primary Examiner* — James O Hansen
(74) *Attorney, Agent, or Firm* — RatnerPrestia

(57) ABSTRACT

A storage device having discrete drawers includes a housing having a frame assembly. A drawer assembly is movably received in the housing. A cover is fixedly mounted atop the drawer assembly preventing access to the contents of the drawer assembly. The drawer assembly is further divided into at least two discrete compartments. An actuator is connected to the frame assembly, the actuator operating to move the drawer assembly along a drawer slide slidably outward from the housing. At least two second actuators are connected to said drawer assembly, each actuator operating to move one of the at least two discrete compartments outward from the drawer assembly such that the cover does not move along with the compartment.

16 Claims, 6 Drawing Sheets

(51) Int. Cl.

| | |
|---|---|
| ***G07F 17/00*** | (2006.01) |
| ***A47B 67/02*** | (2006.01) |
| ***A61J 7/00*** | (2006.01) |

(58) Field of Classification Search
USPC ..... 700/213, 214, 231, 236, 244; 312/209, 312/295, 301, 302, 330.1
See application file for complete search history.

(56) References Cited

U.S. PATENT DOCUMENTS

| | | | | |
|---|---|---|---|---|
| 5,172,829 | A | 12/1992 | Dellicker, Jr. | |
| 5,392,951 | A | 2/1995 | Gardner et al. | |
| 5,745,366 | A | 4/1998 | Higham et al. | |
| 5,805,456 | A | 9/1998 | Higham et al. | |
| 5,883,806 | A | 5/1999 | Meador et al. | |
| 5,905,653 | A | 5/1999 | Higham et al. | |
| 6,011,999 | A | 1/2000 | Holmes | |
| 6,039,467 | A | 3/2000 | Holmes | |
| 6,116,461 | A | 9/2000 | Broadfield et al. | |
| 6,209,978 | B1 | 4/2001 | Khan | |
| 6,338,007 | B1 | 1/2002 | Broadfield et al. | |
| 6,349,999 | B1 | 2/2002 | Takahashi et al. | |
| 6,470,234 | B1 | 10/2002 | McGrady | |
| 6,648,428 | B2 | 11/2003 | Chaloner et al. | |
| 6,698,634 | B2 | 3/2004 | Thomson | |
| 6,785,589 | B2 | 8/2004 | Eggenberger et al. | |
| 7,263,410 | B1 | 8/2007 | Frederick et al. | |
| 7,719,420 | B2 | 5/2010 | Christie et al. | |
| 7,751,932 | B1 | 7/2010 | Fedor et al. | |
| 7,806,488 | B2 | 10/2010 | Hannan et al. | |
| 8,016,370 | B2 | 9/2011 | Grainger | |
| 8,103,379 | B2 | 1/2012 | Biba et al. | |
| 8,831,770 | B2 | 9/2014 | Heffron | |
| 2005/0113970 | A1* | 5/2005 | Holmes | A47B 88/00 700/242 |
| 2007/0235397 | A1 | 10/2007 | Wannop | |
| 2009/0108016 | A1 | 4/2009 | Brown et al. | |
| 2010/0256800 | A1 | 10/2010 | Heffron | |
| 2011/0030034 | A1 | 2/2011 | Ross | |
| 2011/0101018 | A1 | 5/2011 | Shafir | |
| 2011/0140831 | A1 | 6/2011 | Michael | |
| 2011/0245963 | A1 | 10/2011 | Leng | |
| 2012/0004772 | A1 | 1/2012 | Rahilly et al. | |
| 2012/0089248 | A1 | 4/2012 | Biba et al. | |
| 2012/0253510 | A1 | 10/2012 | Thomas et al. | |

OTHER PUBLICATIONS

International Preliminary Report on Patentability, IPEA/US, dated Mar. 20, 2014.
Australian Office Action dated Sep. 14, 2016 for Australian Application No. 2013235404, 3 pages.
European Office Action dated Sep. 5, 2016 for European Application No. 13763729.4, 6 pages.
Examination Report No. 2 issued in Australian Patent Application No. 2013235404 dated Jan. 12, 2017 (3 pages).

* cited by examiner

MEDICATION DISPENSING APPARATUS HAVING DRAWER ASSEMBLY WITH DISCRETE COMPARTMENTS

CROSS-REFERENCE TO RELATED APPLICATIONS

This application is a 371 U.S. National Stage of International Application No. PCT/US2013/032236, filed Mar. 15, 2013. This application claims the benefit of U.S. Provisional Application No. 61/613,305, filed Mar. 20, 2012. The disclosures of the above applications are incorporated herein by reference.

FIELD

The present disclosure relates to inventory management systems including medication storage and dispensing workstations. In particular, the disclosure relates to medication storage and dispensing workstations comprising drawers with discrete storage compartments and a system incorporating same.

BACKGROUND

This section provides background information related to the present disclosure which is not necessarily prior art.

Storage and support assemblies for use in, for example, open structures such as shelving systems or enclosed structures are well known in the art. Typical conventional enclosed structures provide three- or four-sided assemblies supported on a base platform that can be mobile (for carts) or stationary (for cabinets). Generally storage space can be provided in the form of shelves or drawers for storage of various work-related items. Additionally, to facilitate a computer and related components, an open, retractable keyboard shelf can be provided to store a computer keyboard when not in use.

Medication management systems are used in healthcare environments in order to administer the inventory and distribution of medication and other medical supplies to patients. A decentralized unit dose medication dispensing system involves dispensing medications in the patient care areas. Medications are retrieved, e.g., from a medication storage and dispensing workstation, and placed in patient specific containers, transported to the patient care area and administered as prescribed. In addition to hospitals, decentralized medication management systems are used in long term care facilities, clinics, and in other medical environments. In a decentralized medication distribution system, multiple medication dispensing sites are located remotely from a centralized distribution location, such as a facility's pharmacy. The remote dispensing sites, such as a nurses' station in a hospital ward, serve as base stations from which healthcare professionals can readily access medications or other medical supplies to be administered to the patients under their care.

A medication storage and dispensing workstation can comprise a cabinet having a plurality of storage locations, such as drawers, shelves, trays, cassettes, or bins, for example. The storage locations are stocked with individual medications and/or medication doses, or other medical supplies by the pharmacy. The contents of the base stations are thoroughly inventoried and the distribution of medications and medical supplies is carefully controlled. Access to the medication storage and dispensing workstation and to the individual storage locations in the workstation, is limited and can be gained only by healthcare professionals with the appropriate credentials. A user interface that enables access to the workstation and records the inventory and distribution of the medications and medical supplies from the workstation can be computer controlled.

SUMMARY

This section provides a general summary of the disclosure, and is not a comprehensive disclosure of its full scope or all of its features.

The present disclosure provides a medication storage and dispensing workstation for use in a medication management system administering the inventory and distribution of pharmaceuticals and medical supplies in a healthcare environment. The workstation incorporates a narrow, linear drawer assembly having a plurality of discrete storage compartments for containing medications and/or other medical supplies. The storage compartments are arranged in a linear array extending longitudinally along the travel path of the linear drawer assembly. Each storage compartment, in turn, comprises a drawer that is extensible laterally relative to the linear arrangement of the compartments so as to be arranged in a compartmentalized "drawer-in-drawer" configuration.

According to several embodiments, a medication storage and dispensing workstation with linear drawers includes a housing having a frame assembly. A drawer assembly is movably received in the housing. A cover is fixedly mounted atop the drawer assembly preventing access to the contents of the drawer assembly. The drawer assembly is further divided into at least two discrete compartments. A first actuator is connected to the frame assembly, the first actuator operating to move the drawer assembly linearly along one or more drawer slides slidably outward from the housing. At least two second actuators are connected to the drawer assembly, each second actuator operating to move a corresponding discrete compartment outward in a direction lateral to the linear direction the drawer assembly such that the cover does not move along with said discrete compartment.

According to other embodiments, a medication storage and dispensing workstation with linear drawers includes a housing having a frame assembly. Each of a plurality of drawer assemblies is individually movably received in the housing. Each said drawer assembly has a cover fixedly mounted atop each said drawer assembly preventing access to the contents of said drawer assembly. Each said drawer assembly is further divided into at least two discrete compartments. A plurality of first actuators are individually connected to each frame assembly, each first actuator operating to move each said drawer assembly linearly along each corresponding at least one drawer slide slidably outward from the housing. At least two second actuators are connected to each said drawer assembly, each second actuator operating to move a corresponding discrete compartment outward in a direction lateral to the linear direction the drawer assembly moved such that the cover does not move along with said compartment.

In certain other embodiments, a medication storage and dispensing workstation with linear drawers includes a host control module that communicates with any of the said first actuators via command inputs by an operator to activate (for example, energize or deenergize) one, some, or all of the first said actuators, thereby causing the at least one drawer assembly to slide along each at least one drawer slide outward from the housing.

In certain other embodiments, a medication storage and dispensing workstation with linear drawers includes a host control module that first communicates with at least one said first actuator via command inputs by an operator to activate (for example, energize or deenergize) one, some, or all of the first said actuators, thereby causing at least one frame assembly housing a drawer assembly to slide outward from the housing, wherein the host control module then communicates with at least one said second actuator such that said second actuator activates to move at least one discrete compartment outward from said at least one drawer assembly so long as no other drawer assembly is blocking movement, thereby providing access to the at least one discrete compartment.

According to still other embodiments, a medication storage and dispensing workstation according to the present disclosure includes a sensor that indicates to a user which discrete compartment contains the requisite item, or a sensor that records the opening of a drawer and allows the control module to record and warn against accessing the wrong compartment. In certain embodiments, the second actuator triggers said sensor.

According to still other embodiments, a medication storage and dispensing workstation with discrete drawers in drawers includes at least a locking mechanism that prevents user access except to the discrete compartment containing the requisite item.

In certain other embodiments, discrete compartments are prevented from opening until the drawer assembly has slidably moved outside of the frame assembly to the end of the drawer slide.

According to yet other embodiments, the drawer assembly has a drawer extension lock that prevents closing the drawer assembly when the drawer extension lock is engaged in a locking position.

In certain other embodiments, the cover atop the drawer assembly can be secured with a latch, such that a certain key-mechanism is required to open it.

In certain preferred embodiments, the drawer assembly is removable from the housing and interchangeable with other drawer assemblies.

In certain other preferred embodiments, the discrete compartments removably secure into the drawer slide and at least two such compartments form a drawer assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1A:
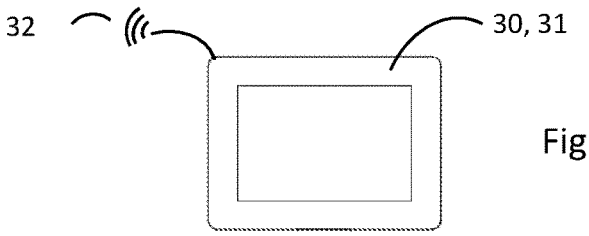
FIG. 1A is a schematic view of an exemplary host control module for use with the exemplary workstation of FIG. 1.
Figure 1:
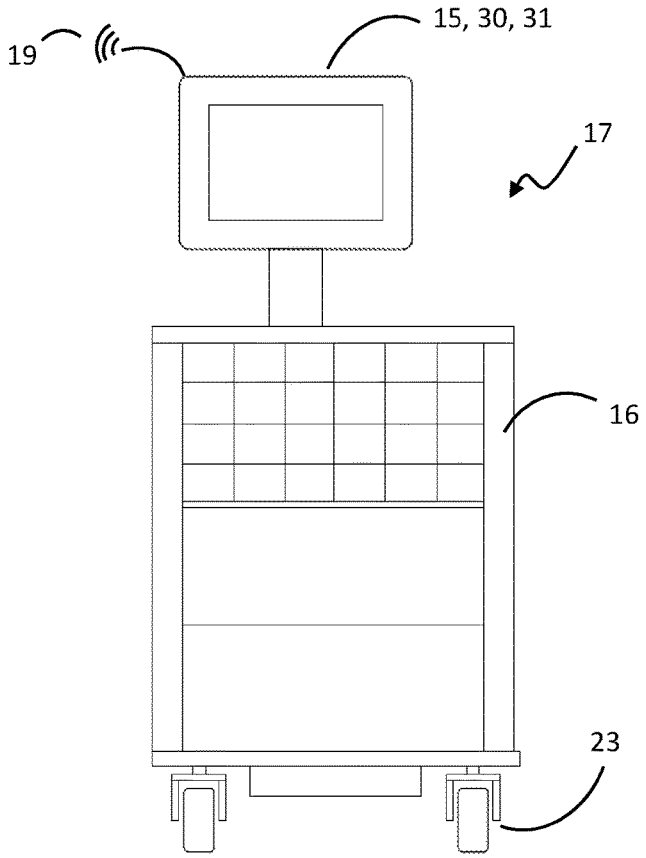
FIG. 1 is a front view of an exemplary workstation having a storage device with discrete compartments according to the present disclosure.

Referring now to the drawings, an exemplary medication storage and dispensing workstation suitable for use in a medication management system administering the inventory and distribution of pharmaceuticals and medical supplies in a healthcare environment and including a linear drawer assembly with discrete, drawer-in-drawer compartments according to the present disclosure is shown in FIG. 1.

The workstations contemplated within the scope of the disclosure can take several forms, including stationary or mobile cabinets, such as automated dispensing machines ("ADMs"), and/or point-of-care (POC) mobile workstations. The workstations can be utilized in any of a variety of medication inventory and distribution models, including centralized, decentralized, local, and mobile distribution models, and generally in areas geared toward acute or long-term patient care. Of course, the workstations can also be employed in other inventory management environments outside of the healthcare field, as well.

Access to the workstation is limited to properly credentialed healthcare professionals by facility protocols. A healthcare professional can gain access to the medication storage modules of the workstation according to established protocols of the facility. Once access is obtained, the healthcare professional can retrieve medication(s) or other medical supplies from the workstation as they are needed or in order to fulfill the prescription requirements of individual patients which are under the healthcare professional's care.

Figure 2:
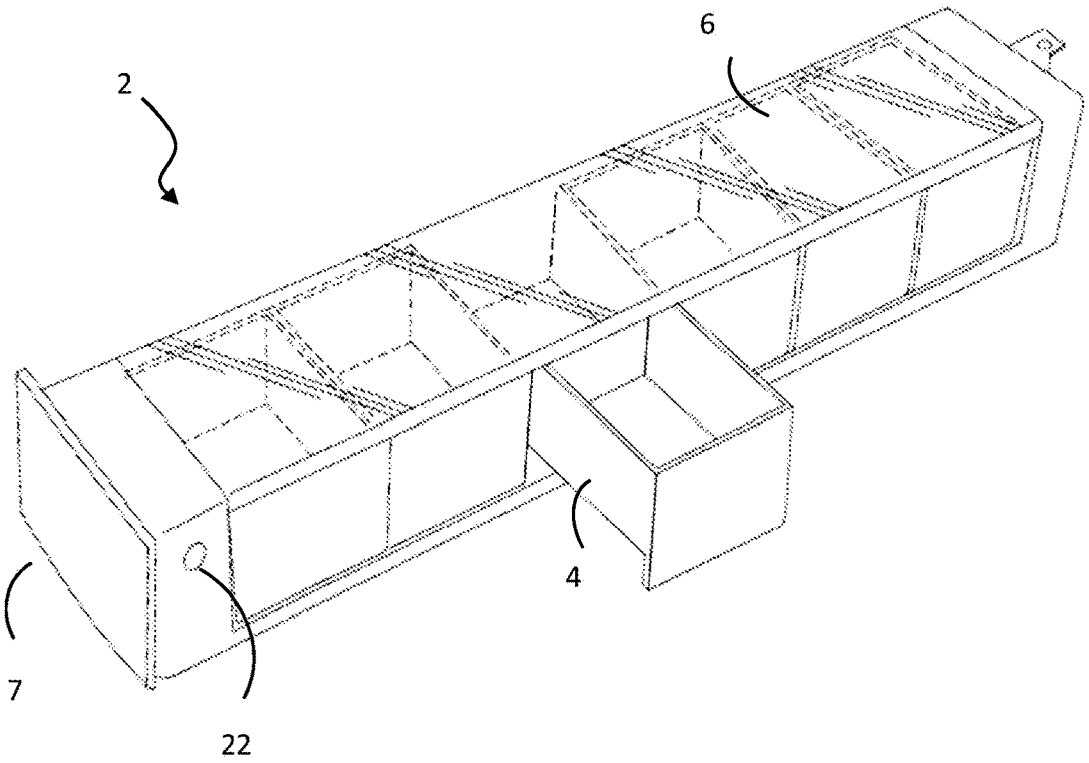
FIG. 2 is front right perspective view of a drawer assembly wherein one of the discrete compartments is extended from the drawer assembly and the cover is transparent.
Figure 3:
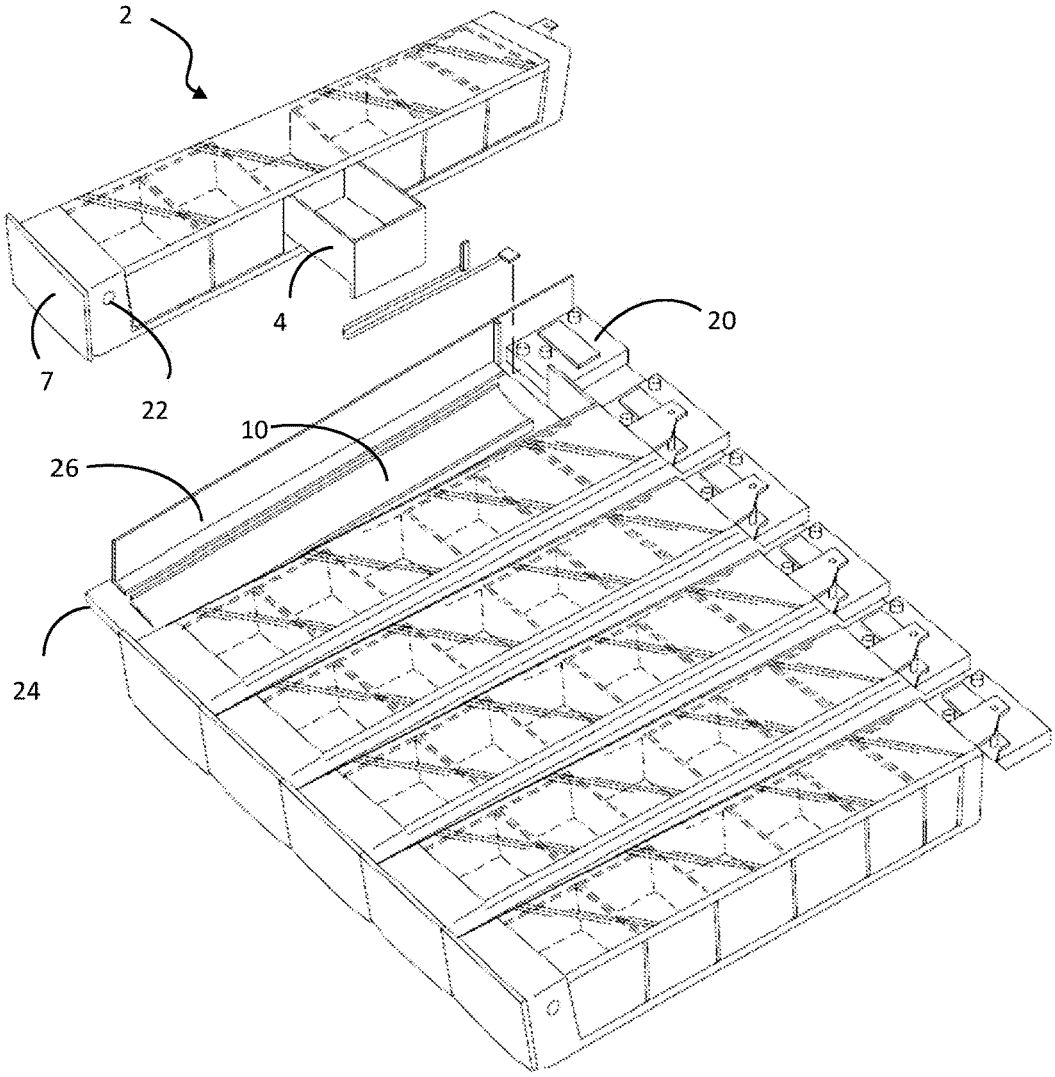
FIG. 3 is a front right perspective view of several drawer assemblies having discrete drawer compartments in which one drawer assembly is removed from a drawer slide assembled adjacent to the other drawer assemblies wherein each cover is transparent.

In FIG. 2, a single drawer assembly 2 having discrete compartments 4 and a cover 6 is shown. FIG. 3 shows several drawer assemblies with a single drawer assembly 2 removed from a drawer slide 10 disposed under drawer assembly 2, wherein drawer slide 10 is operable to maneuver drawer assembly 2 outward from a housing 16 (as shown in FIG. 1). An aesthetic end cover 7 is included at the exposed end of the linear drawer assembly 2. In certain embodiments, multiple drawer assemblies are disposed in a row alongside each other. In such embodiments, a row of drawer assemblies is referred to as a frame assembly.

In certain embodiments, the discrete compartments 4 are operable to project laterally out from corresponding drawer assemblies 2 by the actuation of springing devices. Referring to FIG. 1, a host control module 30 manages communications with a host server 15 and directs the actuation of a first actuator 20 causing a corresponding drawer assembly to move linearly outward from a housing 16, and an actuating device 22 may activate at least one of the at least two second actuators actuating a device (e.g., a springing device) such that said at least a discrete compartment 4 moves in a lateral direction outward from the prior linear movement of said drawer assembly 2, thereby making the contents of said discrete compartment 4 accessible. The first actuator 20 and/or actuating device 22 can each comprise a button, key lock, a linear actuator, a magnetic or any other known electrically or mechanically-actuated mechanism. The first actuator, at least two second actuators and/or actuating device 22 can be actuated remotely via electric signal. The at least two second actuators can operate independent of the actuating device 22.

FIG. 3 shows a more detailed view of the drawer slide sub-assembly 24 of the linear drawer assembly 2. The drawer slide 10 is extensible along a longitudinal axis and is operable to maneuver the linear drawer 2 assembly into and out of the frame assembly 14. The drawer slide sub-assembly 24 includes a base rail 26 that is configured for mounting to the bottom of drawer assembly 2, such as by one or more fasteners, or the like. A slide rail 10 is moveably nested within the base rail 26 and is operable to move linearly relative to the base rail 26 along the longitudinal axis. The frame assembly 14 is attached to the slide rail 10. A latch bracket including a latch bar for engagement with a corresponding linear drawer latch mechanism is included at a rear end of the drawer slide sub-assembly 24.

In some embodiments, the latch mechanism comprises a two-stage latch device that can be electronically controlled. The latch mechanism is contained within a housing and includes a first stage latch comprising a lock bolt that is slidably received within a bracket, a second stage latch comprising an intermediate bracket that is also slidably received in the bracket, and an actuator.

The lock bolt can be normally biased by a spring or other biasing means in an upward direction so as to protrude from an upper of the housing in an engagement position. When in the engagement position, the lock bolt can engage a corresponding receiving aperture in the discrete compartment 4 so as to secure the discrete compartment 4 in place. The intermediate bracket is normally biased by a spring or other biasing means in the same direction as the lock bolt. The intermediate bracket can bear against the lock bolt such that movement of the intermediate bracket in the downward direction also results in movement of the lock bolt in the downward direction. Downward movement of the lock bolt, however, does not result in movement of the intermediate bracket. Therefore, the first stage latch is operable without disturbing the second stage latch. The actuator can engage the intermediate bracket to cause it to move in a downward direction and overcome the upward bias against the intermediate bracket and the lock bolt. The actuator can comprise a memory metal wire. When the memory metal wire is activated, it pulls downward on the intermediate bracket, overcoming the bias against downward movement of the intermediate bracket and the lock bolt, and moves the lock bolt to release the discrete compartment from the linear drawer assembly.

It will be appreciated that the discrete compartments can be arranged such that there are differing amounts of the discrete compartments 4 disposed along a particular drawer assembly 2. Each drawer assembly 2 has a corresponding first actuator 20 such that each drawer assembly 2 can independently move slidably outward from the housing 16. The discrete compartments 4 can be divided in any number of ways, for example, the drawer assembly 2 can be divided in half such that there are two compartments, divided in thirds such that there are three compartments, or divided in sixths such that there are six compartments. The depth of the drawer assembly 2 can also differ depending on user- and/or manufacturer-tailored specifications. The length of each discrete compartment can depend on the length of the drawer assembly and the number of divisions.

A plurality of drawer assemblies containing the discrete compartments can be disposed in a horizontal array in the storage device. As non-limiting examples, the drawer assemblies with discrete compartments can be arranged in rectangular fashion, for example, in X by Y arrangements, wherein X is an integer greater than 1 and refers to the number of discrete compartments in a drawer assembly and Y is an integer at least 1 referring to the number of drawer assemblies in a drawer frame.

According to several embodiments, a host control module 30 and a software module 31 can be incorporated in a general purpose computer, a preprogrammed hardware device, or the like. The host control module 30 and the software module 31 can be incorporated in the host server 15. In other embodiments e.g., FIG. 1A, the host control module 30 can be separate from a mobile workstation 17; the mobile workstation 17 could be equipped with a transceiver 19 such that it can communicate with the host control module 30 having a second transceiver 32. The mobile workstation 17 can, for example, have a wheeled chassis 23.

The host control module 30 and associated software module 31 can comprise a general purpose computer operating under the control of operating system software (e.g., Microsoft Windows®) and hardware drivers that can bridge the communications between a medication inventory management software application program running on the control computer and the controllers of the workstation network system. When the application software is running on the host control module 30, for example, the host control module 30 can communicate with the workstation network system, such as through an Ethernet communications port or a USB communications port. Some of the functions/operations that can be performed through the host control module 30 and/or the application software can include: mapping the inventory in each discrete compartment, including the location, identification, revision levels, etc. of any components; communicating with and controlling each component in the workstation network system; managing firmware upgrades to system hardware components; and running system diagnostics.

The host control module 30 and associated software module can perform functions/operations that include: self-identification; upstream communication functions; discrete compartment communication and control, including identifying the number of available discrete compartment locations (i.e., maximum number of locations in the linear drawer), the identity and/or number of occupied discrete compartment locations, the unique information for each discrete compartment, such as ID, size, firmware revision, tamper state, etc.; assign and manage assigned discrete compartment addresses for each discrete compartment; controlling operation of the command received directed to that discrete compartment address; determining state of lateral drawers; and enabling closure of the linear drawer.

The discrete compartments according to the present disclosure can be organized by medication, or by medications to be delivered to at least a specific patient. The discrete compartments can also be organized by specific user, such as a health care provider. The software module 31 associated with the host control module 30 inventories such organization of the items.

In certain preferred embodiments, multiple workstations having linear drawer assemblies with discrete compartments according to the present disclosure are disclosed. In certain embodiments, one of the workstations with a computer station with transceiving capabilities houses information about the discrete compartments and items contained within the discrete compartments and is wirelessly coupled to the other workstations. In other embodiments, the computer station is physically independent of each workstation.

Each workstation 17 has a transceiver 19 for communicating with a second transceiver connected to a computer station. Data contained in the computer station includes information relating to the items housed within the workstations not having computer stations. In other embodiments, workstations not having computer stations are controlled remotely by interacting with the computer station.

The discrete compartments of a workstation having drawer assemblies according to the present disclosure are loaded in a designated loading zone (e.g., a pharmacy) such that the items contained in the loaded workstation correspond to desired specifications.

The storage device can also enable networking the storage device with other storage devices and/or a centralized medication inventory management system. In this respect, the storage device can comprise a wired network interface, e.g., an Ethernet adaptor for wired network connectivity to a local area network, or a wireless network interface and an antenna for network connectivity to a WLAN. Wired and wireless network interfaces that are well known in the art are suitable for integration into or with the computer of the storage device. Alternatively, or in addition, wireless signals at a frequency (or according to a protocol) other than the WLAN, such as Bluetooth, WiMAX, for example, can be used.

The computer and/or application program can communicate with peripheral devices, such as bar code readers, PDAs, biometric security devices (e.g., a fingerprint scanner), scanners, card readers, keyboards, and the like. The computer and/or application program can incorporate a health care facility's operating protocols for managing the distribution of medications and medical supplies and can be operable to access pertinent data, such as patient-specific prescription information, from a centralized medication inventory management system.

In some embodiments, a health care provider supplies credentials to a computer station or other user-interface module, whereby the computer station or other user-interface module houses data relating to the health care provider. The data includes information about the health care provider's patients and medications corresponding to such patients. The computer station or other user-interface module communicates this data to other workstations via corresponding transceivers, thereby indicating said discrete compartments containing requisite medication the health care provider requires for treatment of patients.

In certain exemplary embodiments of the present disclosure, an indicator, such as an LED light, is activated in response to a request for access to a specific compartment, thereby indicating to the user which discrete compartment should or can be opened. In certain other embodiments, a button or switch is mounted on the drawer assembly, and the push of the button opens the desired compartment, which may or may not include an indicator as described herein. In certain other embodiments, the compartment automatically springs open upon a user requesting a desired compartment. In certain other embodiments, the other compartments are locked so as to restrict entry into any compartment except the one having the requested contents.

In certain other embodiments, the drawer assembly can automatically move slidably outward only partially. A user can open the drawer assembly to its full outward position. In certain embodiments, the drawer assembly can latch upon engaging in a fully outward position. Upon access to the desired discrete compartment, the latch can release, thereby allowing the user to shut the fully opened drawer assembly.

Further, in certain other embodiments, the opening of a discrete compartment is automatically indicated to a host control module. The host control module can be directly connected to the storage device or the storage device can have a transceiver capable of sending an indicator signal to a host control module not directly connected to the storage device. In certain embodiments, the host control module can record the access and/or provide feedback to a user that the correct or incorrect discrete compartment was accessed, depending on specifications. This indication can be in the form of an alert so as to inform a user that an incorrect discrete compartment was selected. In certain other embodiments, the alert can be transferred to some entity other than the user.

In certain other embodiments, the storage device can indicate to a host control module that a discrete compartment was accessed for the purpose of taking inventory.

In one exemplary embodiment, a user would enter specifications into a user interface communicating with a host control module that has inventoried the items contained within a storage device containing at least one drawer assembly according to the present disclosure. The host control module communicates to a transceiver located within the housing, indicating to the transceiver which discrete compartment on which drawer assembly contained the desired item. The transceiver would actuate the actuator juxtaposed to such drawer assembly, thereby causing the drawer assembly to linearly slide outward from the housing. The transceiver would next actuate the actuator in direct connection with the discrete compartment, thereby causing the discrete compartment to travel laterally from the linear direction the drawer assembly had slidably traveled. The user would collect the desired item from the open discrete compartment. The removal of the item would be indicated to the host control module, with the host control module thereby inventorying the item's extraction. The user would then push the discrete compartment back into a closed position, then push the drawer assembly back into the housing. The user can then request a new specification as described above, or can make several specifications initially, wherein the corresponding drawer assemblies and discrete compartments would open sequentially or all at once.

According to other embodiments, a manual key-lock override is directed to actuate some or all of the discrete compartments to move outward from the drawer assembly, whereby the contents of each discrete compartment that moved outward from the drawer assembly is accessible.

Drawer assemblies can be interchangeably removable from the housing, thereby allowing discrete compartments with contents that have been extracted to be quickly exchanged for discrete compartments containing items not yet extracted. In other embodiments, the complete drawer assemblies can be interchanged so as to exchange the items contained in the storage device. In this regard, the drawer assemblies can carry an electronic identification, for example, containing information about the identity of the drawer assembly and/or the discrete compartments therein and/or the items contained in the compartments. The information can be updated, tracked, checked, re-confirmed during the distribution of items from the storage device.

The discrete compartments can be capable of being inserted on a drawer slide, wherein the combination of at least two discrete compartments forms a drawer assembly, wherein the discrete compartments can be removed from the drawer assembly independent of one another, thereby allowing discrete compartments with contents that have been extracted to be quickly exchanged for discrete compartments containing items not yet extracted. In other embodiments, the discrete compartments can be interchanged so as to exchange the items contained in the storage device.

The cover atop the drawer assembly is only removable when the drawer assembly is not in connection with the drawer slide; as such, the discrete compartments could be quickly and easily refilled when at a designated loading zone, but, aside from when the discrete compartments have moved outward from the drawer assembly, the discrete compartments would not be accessible when secured to the drawer slide within the storage device.

Figure 5:
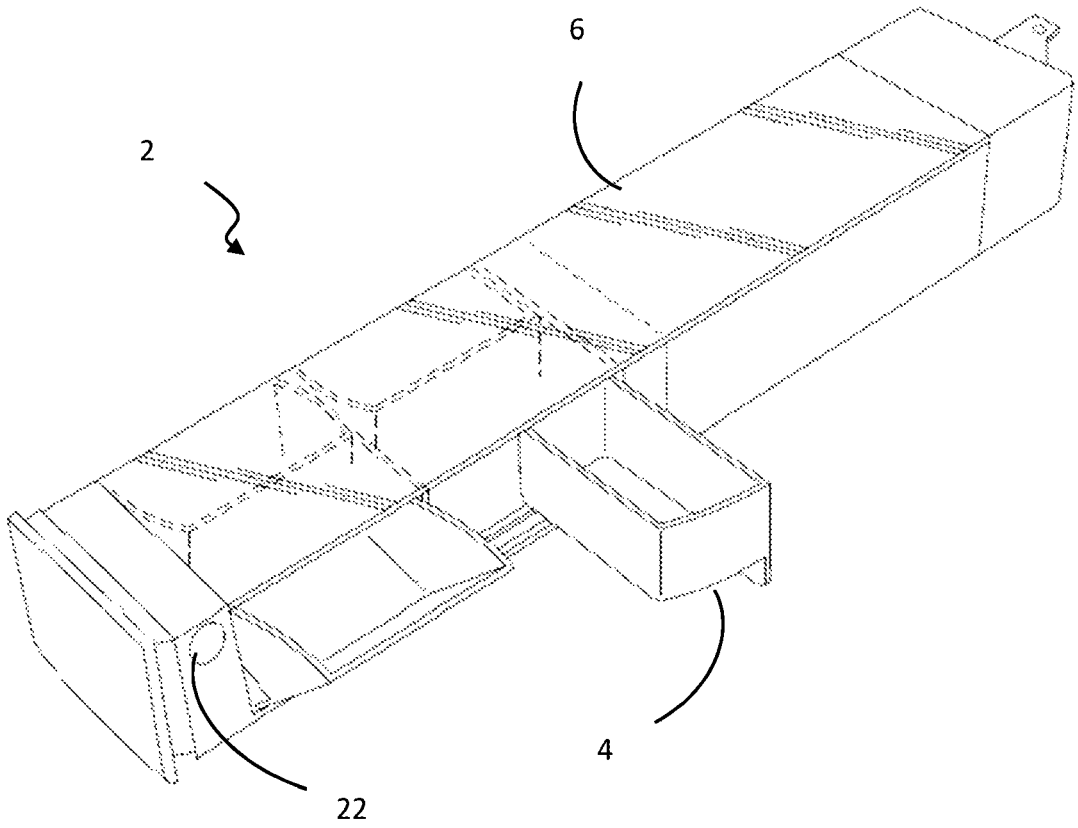
FIG. 5 is a front right perspective view of a drawer assembly including various embodiments of the discrete compartments and the manner in which they can extend from the drawer assembly.

FIG. 5 refers to drawer assemblies having discrete compartments wherein the discrete compartments become accessible in various ways. As examples, the discrete compartments can become accessible by swinging out of the drawer assembly horizontally (e.g., about a vertical axis) at angles, for example, ranging from 45 to 90 degrees. Other drawers might tilt out vertically (e.g., about a horizontal axis) such that the bottom of the discrete compartment is fixedly attached to the drawer assembly at the out-facing direction such that the discrete compartment tilts along the fixed axis.

In certain embodiments, the discrete compartment swings out from the drawer assembly such that the closing of the drawer assembly acts to force an open discrete compartment into a closed position. A latching mechanism might operate such that the closed discrete compartment does not spring open when the drawer assembly moves slidably from the housing. The latching mechanism has means for being disengaged.

Figure 4:
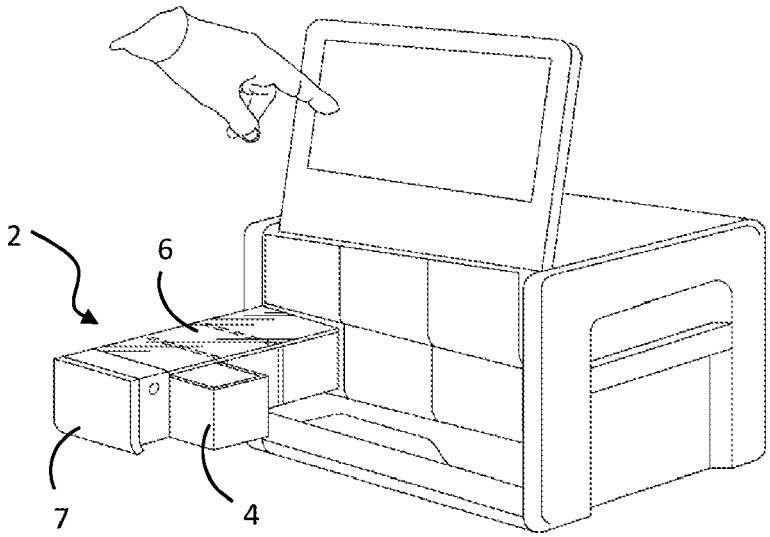
FIG. 4 is a front right perspective view of another exemplary workstation utilizing the discrete compartments in a drawer assembly with a transparent cover.

In certain embodiments, the drawer assembly according to the current invention could exist as a component part of workstations. Referring to FIGS. 1 and 4, a workstation generally includes a housing that might contain the discrete compartments according to the present disclosure. The workstation typically includes a control module, a user interface module input/output device, such as one or more keyboards, which can be located on a keyboard tray, on a display, or on a work surface, a UPC or similar data reading device, a software module providing software for operation of at least a control module, and a storage cabinet. In other embodiments, e.g., FIG. 1, the workstation 17 can be mobile by including a wheeled chassis 23 permitting transportation of the workstation.

A workstation incorporating a linear drawer assembly according to the present disclosure has an efficiency over other known workstations. Known medical dispensary apparatuses require opening drawers that are bulky and not conducive to a small, enclosed area as can be encountered in a crowded hallway. The linear drawer assemblies with discrete compartments according to the present disclosure, however, do not require a drawer spanning the entire width of the dispensary apparatus to extend from the apparatus, thereby allowing the user to utilize the workstation in a smaller area.

Figure 6:
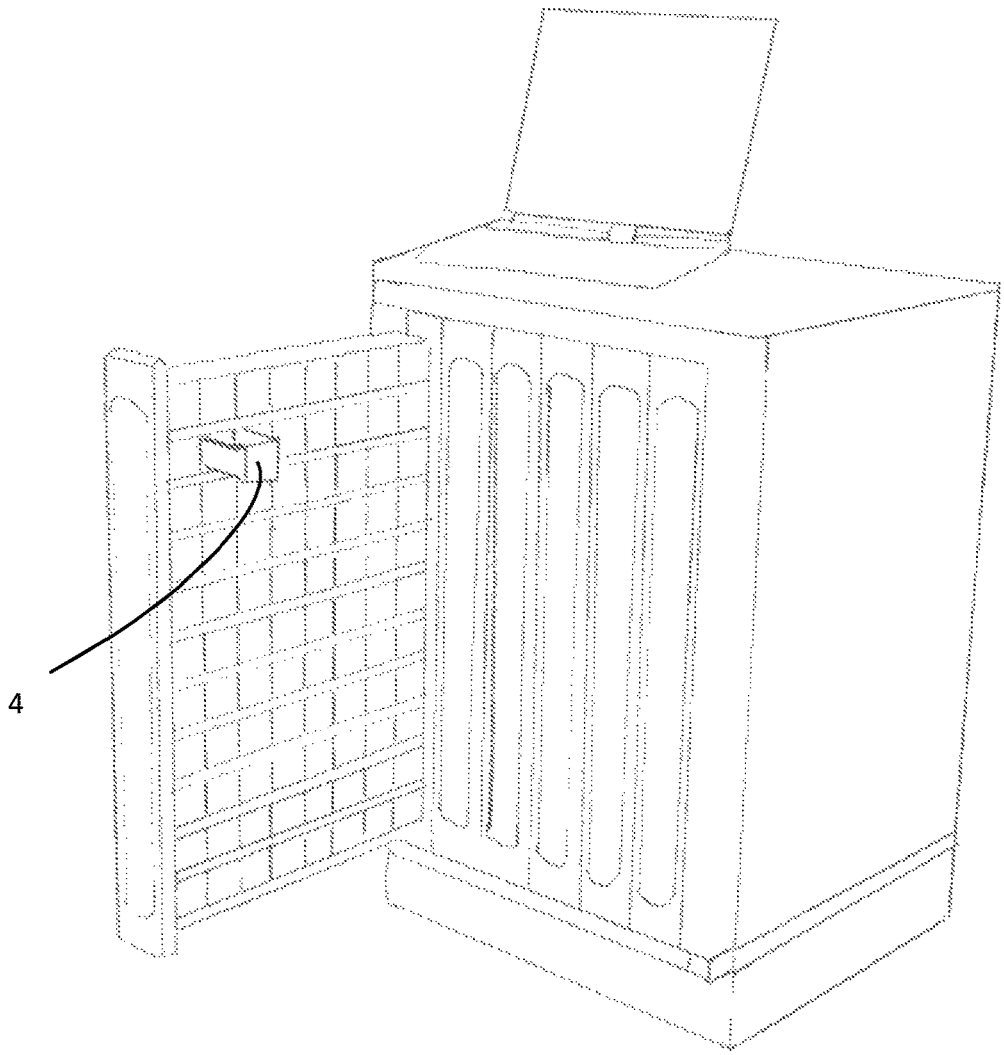
FIG. 6 is a front right perspective view of a drawer assembly having a storage device with discrete compartments according to an alternate embodiment of the present disclosure.

As can be appreciated, a workstation according to the principles of the present disclosure can incorporate drawer assemblies that are organized vertically rather than horizontally, such that the discrete compartments are disposed in a vertical manner, as shown in FIG. 6. Additionally, the workstation can include a plurality of drawer assemblies such as described above and a plurality of different types of storage units, such as fixed wire shelves, retractable wire shelves, drawers-behind-doors, ISO bin supplies, center-closing doors, main drawers, and full-width drawers. The storage device can be organized with drawer assemblies having discrete compartments according to the present disclosure and other types of storage units, depending on organizational needs or user preference.

The drawer assembly having discrete compartments according to the present disclosure can be used in a variety of applications and/or vehicles. As non-limiting examples, the drawer assemblies having discrete compartments can be utilized in POC workstations; in stationary and/or mobile storage cabinets located in patient rooms or included in various inventory distribution models, including decentralized, local, and mobile distribution models; in automated dispensing machines; and generally in areas facilitating acute or long-term care.

The workstation can be employed in a variety of locations, including in patient rooms, e.g., as part of or mounted on a wall, on an over-the-bed table, on an arm of the patient monitoring unit, or as part of a free-standing cart. The workstation can be secondarily secured behind a hinged or tambour door cabinet.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same can also be varied in many ways. Such variations are not to be regarded as a departure from the disclosure, and all such modifications are intended to be included within the scope of the disclosure.

What is claimed is:

1. A storage and dispensing workstation, comprising:

a housing;

a plurality of drawer slides positioned horizontally adjacent to one another in the housing along a lateral axis, each drawer slide comprising a first member and a second member, the first member being attached to the housing and the second member being linearly movable relative to the first member along a longitudinal axis;

a plurality of single-row drawer assemblies, each single-row drawer assembly disposed on top of a corresponding drawer slide and moveable with second member such that each single-row drawer assembly is linearly extensible as a single-row from the housing along a direction of the longitudinal axis independent of the other single-row drawer assemblies in the storage and dispensing workstation;

each single-row drawer assembly comprising a plurality of discrete compartments located adjacent to one another in a single-row horizontal linear array along the longitudinal axis, such that the single-row horizontal linear array of compartments in each drawer assembly are extendable from the housing independent of other compartments in the other single-row drawer assemblies such that a top of the compartments in each single-row drawer assembly is visible when the single-row drawer assembly is extended from the housing, wherein each of the compartments is linearly extensible from the single-row drawer assembly along a direction of the lateral axis and generally perpendicular to the longitudinal axis;

a plurality of first actuators connected to the housing, each first actuator operating to move a corresponding single-row drawer assembly linearly outwardly from the housing;

a plurality of second actuators connected to each single-row drawer assembly, each second actuator operating to move a corresponding one of the plurality of discrete compartments linearly outwardly from the single-row drawer assembly from a closed position to an opened position;

a single cover mounted to each single-row drawer assembly and covering each of the discrete compartments of the single-row drawer assembly, wherein the cover prevents access to each of the compartments when they are in the closed position, wherein the cover of the single-row drawer assembly is permanently fixed to the single-row drawer assembly such that it does not move with the discrete compartments when each of the discrete compartments is moved between the closed position and the opened position.

2. The storage and dispensing workstation of claim 1, further including a host control module in communication with the actuators operating with commands input by an operator to operate the first and second actuators in tandem with one another such that the discrete compartment does not move outward from the single-row drawer assembly until the single-row drawer assembly has moved slidably outward from the housing.

3. The storage and dispensing workstation of claim 1, wherein users are prevented access to the discrete compartments without supplying proper credentials.

4. The storage and dispensing workstation of claim 1, wherein the single-row drawer assembly is removably secured to the drawer slide.

5. The storage and dispensing workstation of claim 1, wherein the discrete compartments are removably secured to the single-row drawer assembly.

6. The storage and dispensing workstation of claim 1, wherein the discrete compartments are removably secured to the single-row drawer assembly.

7. The storage and dispensing workstation of claim 6, further including a host control module in communication with the plurality of second actuators, the control module controlling the moving of each of the discrete compartments from the closed position to the opened position.

8. The storage and dispensing workstation of claim 7, wherein each single-row drawer assembly is individually removably received in the housing.

9. The storage and dispensing workstation of claim 1, wherein the first actuator and the plurality of second actuators have means for communicating with a first transceiver, wherein communication from the transceiver actuates at least the first actuator.

10. The storage and dispensing workstation of claim 9, wherein the first transceiver actuates at least one of the plurality of second actuators.

11. The storage and dispensing workstation of claim 10, further comprising a host control module with a second transceiver, wherein the first and second transceivers are in communication with each other.

12. The storage and dispensing workstation of claim 1, wherein the cover is transparent.

13. The storage and dispensing workstation of claim 1, further comprising an end cover positioned on a leading end of the single-row drawer assembly.

14. A storage and dispensing workstation, comprising:

a housing;

a plurality of single-row drawer assemblies arranged in a two-dimensional array in the housing, with a first dimension of the two-dimensional array extending horizontally along a lateral axis of the housing and a second dimension of the two-dimensional array extending vertically in the housing;

a plurality of drawer slides in the housing, each drawer slide comprising a first member and a second member, the first member being attached to the housing and the second member being linearly movable relative to the first member along a longitudinal axis that is perpendicular to the lateral axis;

wherein each single-row drawer assembly of the plurality of drawer assemblies is disposed on top of a corresponding drawer slide such that the single-row drawer assembly is linearly extensible from the housing along the longitudinal axis independent of the other single-row drawer assemblies in the storage and dispensing workstation;

wherein each single-row drawer assembly comprises a plurality of discrete compartments arranged adjacent to one another in the single-row drawer assembly in a single-row horizontal linear array along the longitudinal axis, such that the single-row horizontal linear array of compartments in each drawer assembly are extendable from the housing independent of other compartments in the other single-row drawer assemblies such that a top of the compartments in each single-row drawer assembly is visible when the single-row drawer assembly is extended from the housing, wherein each of the discrete compartments is linearly extensible from the single-row drawer assembly outwardly along the lateral axis between a closed and opened position, and wherein each of the discrete compartments is removable from the single-row drawer assembly;

a plurality of first actuators connected to the housing, each first actuator operable to move a corresponding single-row drawer assembly linearly outwardly from the housing;

a plurality of second actuators connected to each single-row drawer assembly, each second actuator operable to move a corresponding one of plurality of discrete compartments linearly outwardly from the single-row drawer assembly from the closed position to the opened position;

a single cover affixed to each single-row drawer assembly and covering all of the discrete compartments of the single-row drawer assembly, wherein the single cover prevents access to all of the discrete compartments when the discrete compartments are in the closed position; and wherein the cover of the single-row drawer assembly is not attached to the discrete compartments and is not removed from the single-row drawer assembly when any of the discrete compartments is removed from the single-row drawer assembly.

15. The storage and dispensing workstation of claim 14, wherein the cover is transparent.

16. The storage and dispensing workstation of claim 15, further comprising an end cover positioned on a leading end of the single-row drawer assembly.

* * * * *